United States Patent [19]

Greenfield

[11] 4,338,067

[45] Jul. 6, 1982

[54] ALTERNATING PISTON MACHINE WITH ROTATING END WALLS AND CHAIN DRIVE

[76] Inventor: Stuart T. Greenfield, R.R. 2, Ellsworth, Iowa 50075

[21] Appl. No.: 121,498

[22] Filed: Feb. 14, 1980

[51] Int. Cl.[3] ..... F01C 1/063; F03C 2/00; F04C 2/063; F04C 18/063

[52] U.S. Cl. ..... 418/37; 418/36

[58] Field of Search ..... 418/18, 33-37; 123/43 B, 245

[56] References Cited

U.S. PATENT DOCUMENTS

| | | | |
|---|---|---|---|
| 1,482,628 | 2/1924 | Bullington | 418/36 |
| 2,108,385 | 2/1938 | Murakami | 418/36 |
| 2,211,292 | 8/1940 | Ryerson | 418/18 |
| 3,203,405 | 8/1965 | Sabet | 418/18 |
| 3,256,866 | 6/1966 | Bauer | 418/37 |
| 3,769,946 | 11/1973 | Scherrer | 418/36 |
| 3,820,516 | 6/1974 | Paleologos | 418/36 |
| 4,028,019 | 6/1977 | Wildhaber | 418/36 |

FOREIGN PATENT DOCUMENTS

| | | | |
|---|---|---|---|
| 585064 | 12/1924 | France | 418/36 |

*Primary Examiner*—John J. Vrablik

*Attorney, Agent, or Firm*—Zarley, McKee, Thomte, Voorhees & Sease

[57] ABSTRACT

The present invention comprises two complementary gear wheels each of which have a plurality of vanes fixed to the interior faces thereof. The vanes are interlocked in overlapping relationship and the gears are free to rotate independently of one another at different speeds so as to cause the gaps or chambers between the vanes to vary depending upon the changes in the relative speed of the two wheels with respect to one another. Various means are provided for driving the two wheels independently of one another at varying speed ratios. Chain and sprockets may be used, or complementary gears of varying shapes and having different numbers of lobes may be used to accomplish different patterns of movement of the two wheels with respect to one another. Furthermore, variable drive means may be provided for driving the two wheels so as to provide positive control of the variance in the movement of the two wheels.

3 Claims, 15 Drawing Figures

ALTERNATING PISTON MACHINE WITH ROTATING END WALLS AND CHAIN DRIVE

BACKGROUND OF THE INVENTION

The present invention relates to rotary piston machines and methods for operating the same.

Rotaty piston machines have been provided in the past, but these machines have been complicated in construction and inferior in efficiency. Furthermore, these prior art machines have not been susceptible to adjustment so as to change the stroke of the rotary pistons to the desired length. Furthermore, the means for driving these rotary piston machines in the prior art have not been readily adaptable to modification for providing different numbers of chambers in the rotary piston machine.

SUMMARY OF THE INVENTION

The present invention utilizes a pair of facing wheels which are rotatable independently of one another. A plurality of vanes or pistons are fixed to the interior facing surfaces of each of the wheels, and are overlapped in alternate relation. The two wheels are rotated independently of one another at varying velocities so that the vanes attached to one wheel rotate faster at one portion of the cycle than the vanes attached to the other wheel, and during the remaining portion of the cycle, the relative speed of the vanes are reversed. This causes a compression and expansion of the chambers between the vanes, thereby producing a pumping action.

Numerous means may be utilized for driving the two wheels of the present invention to accomplish the result set forth above. One method contemplates the use of a chain driven by eccentrically mounted gears so that rotation of the eccentric gears causes the chain to move first at a fast velocity and then at a slower relative velocity. The chain intermixes with gear teeth on the pump wheels, and thence the pump wheels are driven at increasing and decreasing velocities according to the velocity of the chains.

Another method for driving the wheels contemplates the use of gears meshed with gear teeth mounted on the pump wheels. By using varying shapes and sizes of gears, it is possible to accomplish different patterns of movement of the gear wheels. Consequently, it is possible to achieve varying gear ratios and also varying numbers of chambers in the pump according to the desired result.

Therefore, a primary object of the present invention is the provision of an improved rotatable piston machine and method for operating same.

A further object of the present invention is the provision of a rotating piston machine utilizing two independently rotatable wheels each having a set of vanes or pistons attached thereto, the two wheels being driven at different speed velocities so as to cause variance of the distance between the vanes.

A further object of the present invention is the provision of a rotating piston machine which may be utilized either as an engine or as a pump.

A further object of the present invention is the provision of a device which may be utilized as a pump for compressing gases or pumping liquids, or as a motor driven by compressed gases or pumped liquids.

A further object of the present invention is the provision of a device wherein the stroke of the pistons may be varied to achieve the desired efficiency and power ratios.

A further object of the present invention is the provision of a device which may be provided with any desired even number of chambers.

A further object of the present invention is the provision of a device which is economical to manufacture, durable in use and efficient in operation.

DETAILED DESCRIPTION

Figure 1:
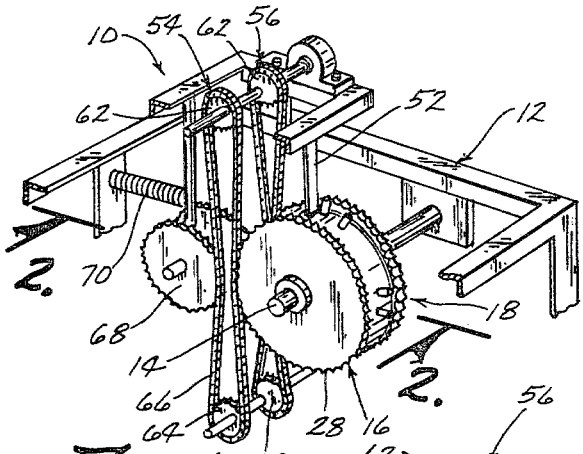
FIG. 1 is a perspective view of one modification of the present invention.
Figure 3:
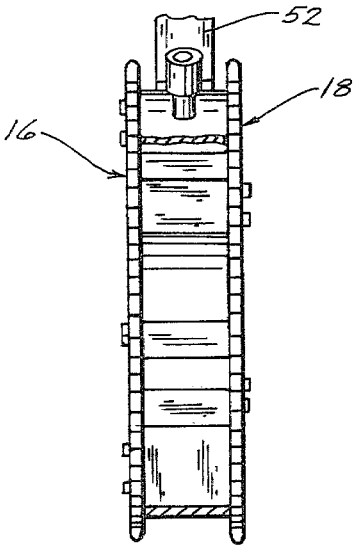
FIG. 3 is a sectional view taken along line 3—3 of FIG. 2.

Referring to FIGS. 1–9, the numeral 10 generally designates the rotary cylinder machine of the present invention. Machine 10 is supported by a frame 12. A wheel axle 14 is supported by frame 12 and has a pair of circular wheels 16, 18 rotatably mounted thereon for rotation independently of one another. Wheels 16, 18 are shown in greater detail in FIGS. 4 and 5. Wheels 16 comprise a circular wheel gear 20, having a circular plate 22, secured to its interiorally presented face by a plurality of screws 24.

Also held to wheel gear 16 by screws 24 are a plurality of vanes or pistons 26. Wheel gear 20 includes a plurality of teeth 28 on its outer peripheral edge.

Wheel 18 is of similar construction to wheel 16 and includes a circular wheel gear 30, a circular plate 32, and vanes or pistons 34 which are held in place by screws 36.

Wheels 16 and 18 include an aperture 38 extending therethrough for receiving wheel axle 14. Also rotatably journaled upon wheel axle 14 is a hub 40 which has a hole 42 for receiving wheel axle 14. Hub 42 is positioned between wheels 16, 18 and provides a spacer therebetween. Wheels 16, 18 are snugly held against hub 40 by blocking bushings 44 (FIG. 1).

In this position, vanes 26 are alternatively positioned between vanes 34 so that eight separate chambers are defined between the vanes. An outer ring 46 surrounds the outer circumferential edges of circular plates 22, 32, and encloses vanes 26, 34 so that the chambers between vanes 26, 34 are enclosed by ring 46 on the outer circumferential edge and by hub 40 on the inner circumferential edge thereof. Ring 46 is provided with four intake valves or ports 48 and four output valves or ports 50.

Ring 46 is attached to frame 12 by a bracket 52 so that frame 46 does not rotate on axle 14 but instead is stationary. All the remaining parts of wheels 16, 18 rotate on axle 14.

Figure 2:
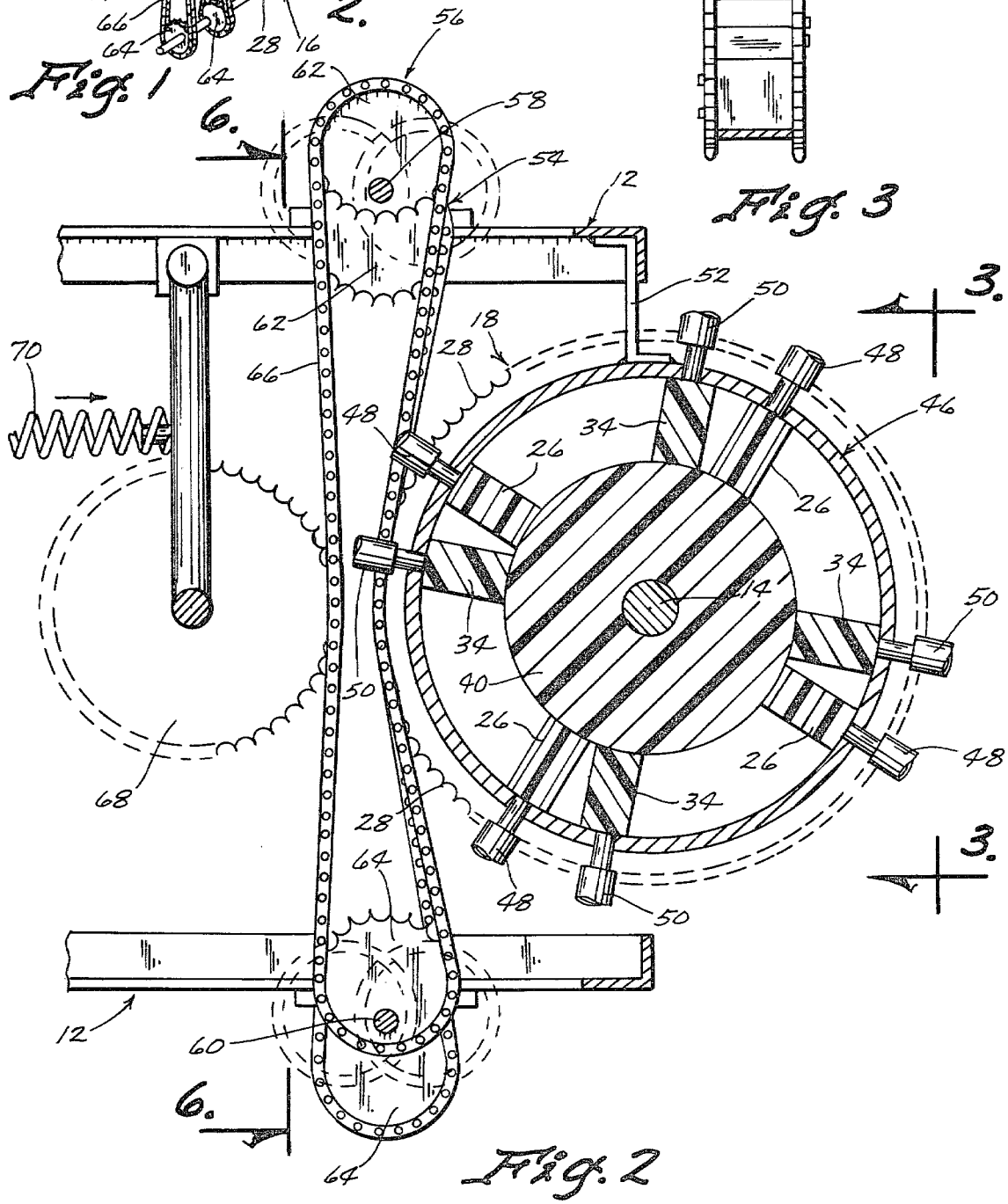
FIG. 2 is a sectional view taken along line 2—2 of FIG. 1.
Figure 4:
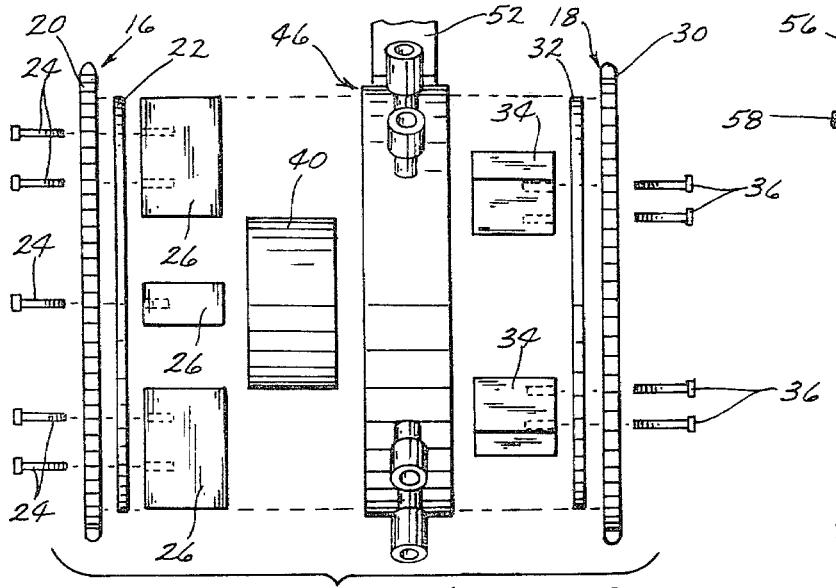
FIG. 4 is a view similar to FIG. 3, but showing the parts in exploded relation.
Figure 5:
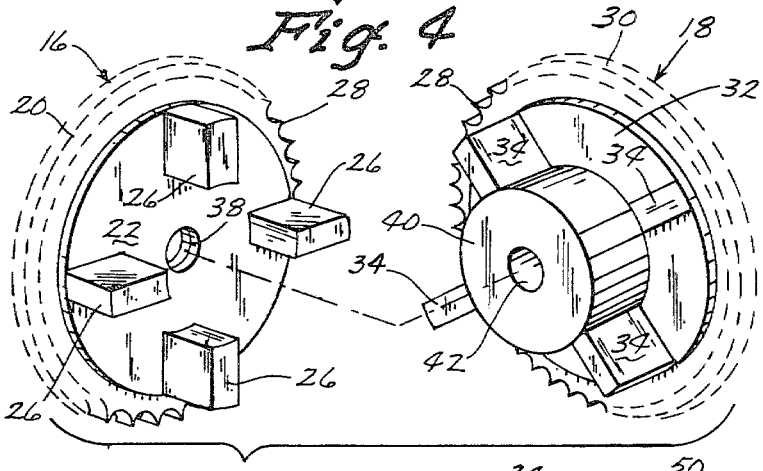
FIG. 5 is a perspective view of the two pump wheels of the present invention.

The means for driving wheels 16, 18 are provided by chain and sprocket assemblies 54, 56 respectively. Sprocket assembly 56 is shown in FIG. 2 and comprises a pair of spaced apart sprocket axles 58, 60, each of which is rotatably journaled in frame 12. Either axle 58 or axle 60 may be driven by a motor or other power means when the device is used as a pump, and when the device is used as a motor or engine, either axle 58 or axle 60 may be utilized as an output shaft. Mounted on axle 58, 60 are a pair of circular chain sprockets 62, 64 one of which is fixed to its respective shaft and one of which is rotatably mounted on its respective shaft. Sprockets 62, 64 are circular, but they are mounted to shaft 58, 60 in eccentric fashion so that shafts 58, 60 extend through a point located off center from the geometric center of the circular sprockets 62, 64. A chain 66 is trained around sprockets 62, 64 and engages teeth 28 of circular wheel gear 30 of wheel 18. An idler sprocket 68 is yieldably urged against chain 66 by a spring means 70 so as to take up any slack in chain 66.

Rotation of axles 58, 60 causes sprockets 62 to move chain 66 in a lineal direction around sprockets 62, 64. If the rotational velocity of shafts 58, 60 is constant, the lineal velocity of chain 66 varies throughout a single revolution of shafts 58, 60. Thus, a cyclical pattern of increased and decreased velocity of chain 66 is accomplished by rotating shafts 58, 60 at a constant velocity. The cyclical pattern of increased and decreased velocity of chain 66 may be varied by changing the geometric position of axles 58 with respect to sprockets 62, 64. For example, the placing of the axles at the geometric centers of these sprockets would result in constant lineal velocity of chain 66, but placing them varying distances off center will create different patterns of increased and decreased velocity of chain 66.

The increasing and decreasing pattern velocity of chain 66 is imparted by chain 66 to wheel 18, thereby causing wheel 18 to rotate in a cyclical pattern of increasing and decreasing velocity.

Figure 6:
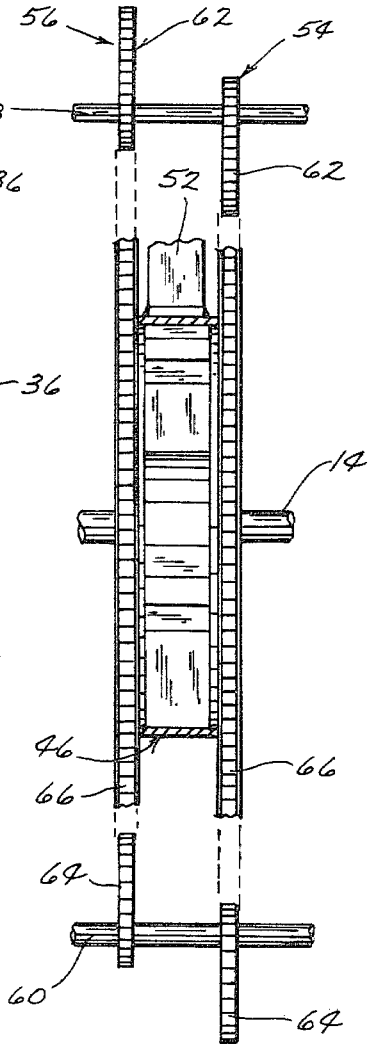
FIG. 6 is a sectional view taken along line 6—6 of FIG. 2.

Chain and sprocket assembly 54 is of identical construction to chain and sprocket assembly 56, and therefore corresponding numerals are used in FIG. 6 to identify the components of chain and sprocket assemblies 54. However, sprockets 62, 64 of assembly 54 are rotated 180° on shafts 58, 60 from the position of sprockets 62, 64 of chain assemblies 56. Thus, the sprockets of assembly 54 are 180° out of phase with the sprockets of assembly 56. The result of this construction is that wheels 16, 18 each rotate in identical patterns of increased and decreased velocity, but the patterns are out of phase with one another so that wheel 16 is increasing in velocity at the time that wheel 18 is decreasing in velocity, and at a later stage of the cycle, wheel 18 is increasing in velocity while wheel 16 is decreasing in velocity. Because of these different velocities between wheels 16 and 18, vanes 26 and vanes 34 are constantly moving rotationally with respect to one another as is readily illustrated in FIGS. 7, 8 and 9.

Figure 7:
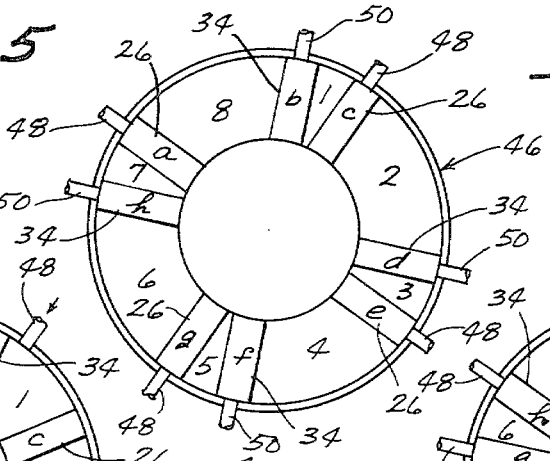
FIGS. 7, 8 and 9 are schematic diagrams showing the inner-relationships of the various vanes or pistons.

Referring to FIG. 7, the vanes 26 are given identification letters a, c, e, and g, and the vanes 34 are given identification letters, b, d, f, and h. The chambers between the vanes are identified by the numerals 1 through 8. In their initial position the vanes are all located in juxtaposition over valves 48, 50 so that no fluid is permitted to either enter or leave the chambers 1 through 8. This position is shown in FIG. 7.

Figure 8:
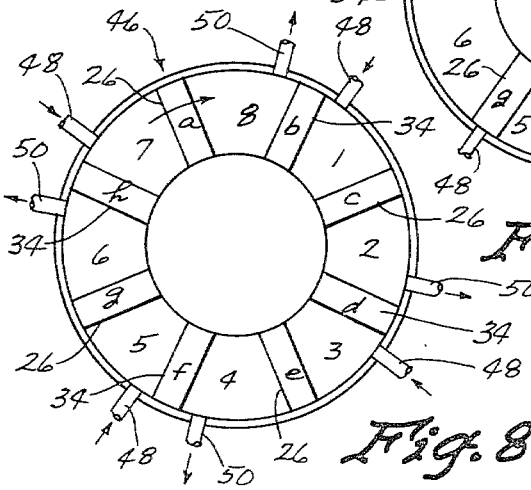
Figure 9:
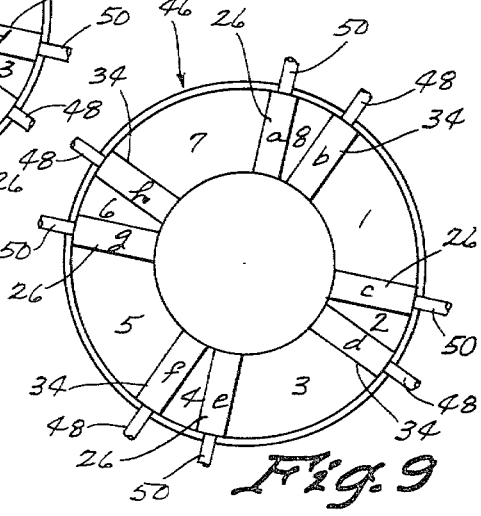

FIG. 8 illustrates the position of the vanes as wheels 16, 18 begin rotating. Since one wheel is rotating faster than the other during this portion of the cycle, half of the vanes a, c, e, and g, gain on the other half of the vanes b, d, f, and h. Thus, the chamber 8 in front of vane a diminishes in size from that size shown in FIG. 7 to that shown in FIG. 8. However, behind vane a, chamber 7 begins enlarging in size from the size shown in FIG. 7 to the size shown in FIG. 8. FIG. 9 shows a completion of the first half of the cycle, and shows that vane a has moved from the position shown in FIG. 7 to the position shown in FIG. 9. Chamber 8 has been diminished from the size shown in FIG. 8 to the size shown in FIG. 9.

In the remaining portion of the cycle, the relative velocities of vanes a and b reverse with vane b traveling faster than vane a, so as to cause chamber 8 to enlarge with the conclusion of the cycle being when vane a reaches valve 48 and when vane b in the same time reaches valve 50 in FIG. 9.

Thus, throughout the cycles of the various vanes, valves 50 serve as exhaust or output valves and valves 48 serve as intake valves, with fluid constantly being drawn inwardly through valve 48 and with fluid constantly being expelled through valves 50.

The length of stroke of the vanes may be varied by changing the geometry of chain and sprocket assemblies 54, 56 so as to vary the pattern of relative speeds between wheels 16 18. As the stroke is changed, of course, the relative positions of valves 48, 50 must also be altered.

Figure 10:
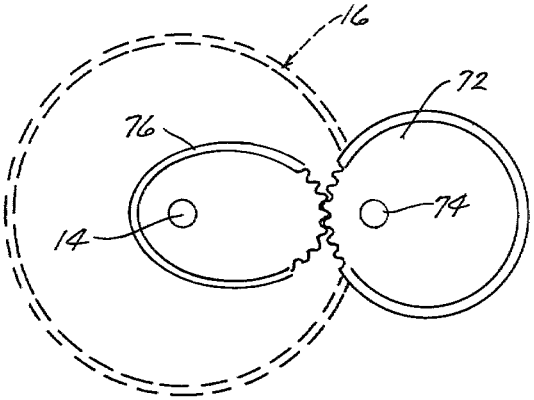
FIGS. 10–15 are schematic views of various possible drive mechanisms for the present invention.

Referring to FIGS. 10–14, various means are shown for driving wheels 16, 18 in different patterns of velocity. For example, FIG. 10 shows a system for driving wheels 16, 18 in a two cycle (and consequently two chamber) configuration. FIG. 10 illustrates only the drive system for one of the wheels 16, 18, the other system being identical, but out of phase, with the one shown in FIG. 10. In FIG. 10, a drive gear 72 is circular in construction and is eccentrically mounted on a shaft 74. An elliptical gear 76 is fixed to wheel 16 with one of its elliptical axes coinciding with shaft 14. The eccentric mounting of drive gear 72 is chosen so that the gear teeth on drive gear 72 remain in meshing engagement with the gear teeth on eccentric gear 76 throughout the rotational cycles of gears 72, 76. By rotating shaft 74 in a constant velocity, a single cycle of increased and decreased velocity per revolution of shaft 74 is achieved. Only one vane on each wheel 16, 18 is used, thereby creating a two chamber device as opposed to the eight chamber device shown in FIGS. 1 through 9.

Figure 12:
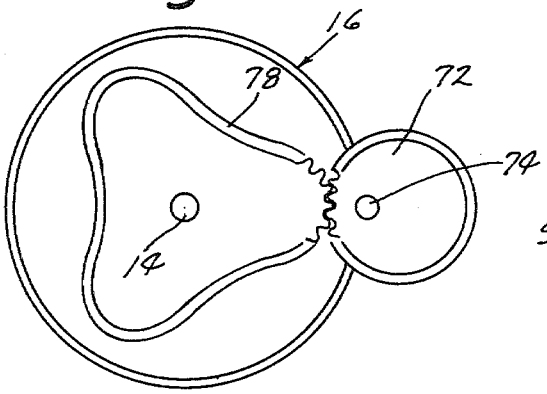

Referring to FIG. 12, a similar drive gear 72 is mounted on a shaft 74 in the same fashion as that shown in FIG. 10. However, instead of an elliptical gear 76, the device in FIG. 12 uses a three lobed gear 78. In this configuration, three vanes are included on each wheel 16, 18, thereby producing a six chambered device. The geometry of gears 72, 78 are chosen so that the teeth of gears 72, 78 remain in constant engagement, thereby creating the increasing velocity and decreasing velocity cycles per revolution of shaft 74.

Figure 15:
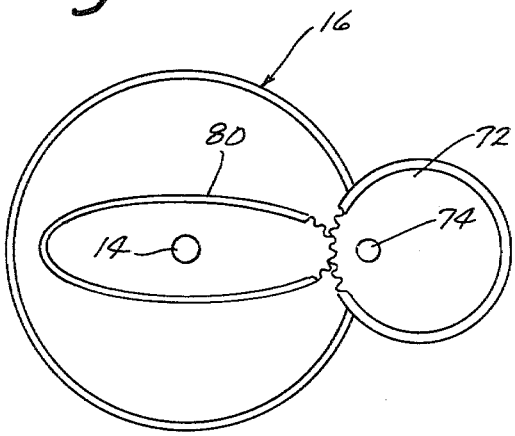

FIG. 15 illustrates a four chamber configuration which utilizes a two lobed gear 80. In this configuration two vanes are used for each wheel 16, 18.

Figure 11:
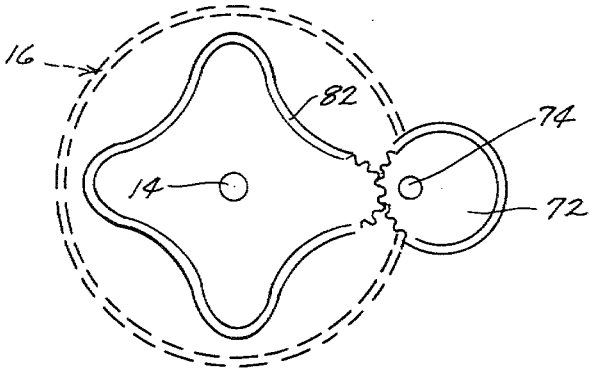

FIG. 11 illustrates an eight chamber device utilizing a four lobed gear 82.

Figure 13:
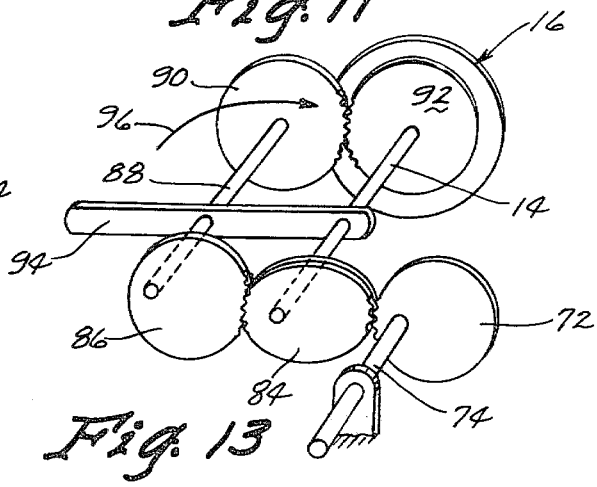
Figure 14:
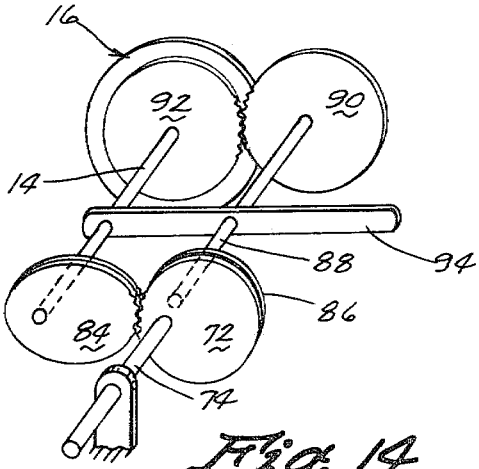

FIGS. 13 and 14 illustrate a means for driving wheel 16 which permits simple adjustment of the amount of change of velocity in wheel 16. The device of FIGS. 13 and 14 comprises a drive gear 72 and drive shaft 74 of similar construction to that shown in FIGS. 10, 11, 12 and 15. Rotatably mounted on shaft 14 is a double thickness elliptical gear 84. Gear 84 rotates independently on shaft 14 from wheel 16 so that rotation of gear 84 does not cause rotation of wheel 16 directly. Gear 84 is meshed with an eccentrically mounted circular gear 86 which is fixed to a movable shaft 88. The opposite end of movable shaft 88 has fixed thereto a circular gear 90 which is centrally mounted on shaft 88 and which engages a complementary circular gear 92 attached to one face of wheel 16. The gear ratio between gears 90, 92 is 1:1. Shaft 88 is rotatably journaled in a pivotal lever 94. Lever 94 is also rotatably mounted on shaft 14 and is adapted to pivot utilizing shaft 14 as a fulcrum.

In operation, when the device is in the position shown in FIG. 13, shaft 74 is rotated at a constant velocity, and gears 72, 84, and 86 mesh to rotate shaft 88 in a predetermined pattern of increasing and decreasing velocity. Rotation of shaft 88 is imparted to gear 90 and because of the 1:1 ratio between gear 90 and gear 92, wheel 16 rotates in the same pattern as shaft 88.

When it is desired to change the pattern of rotation, the operator merely rotates lever 94 upwardly in the arc designated by the numeral 96. Lever 94 rotates from the position shown in FIG. 13 to the position shown in FIG. 14. In FIG. 14, it should be noted that the distance between shafts 14 and 88 is chosen to be identical to the distance between shafts 14 and 74 so that in the position shown in FIG. 14, shafts 88 and shafts 74 are in registered alignment. Consequently, rotation of shaft 74 is imparted from gear 72 to gear 84 and from gear 84 to gear 86, and because shafts 74 and 88 are in registered alignment, the rotation of shaft 88, wheel 90 and wheel 16 is identical in velocity to the rotational velocity of shaft 74. Thus, the position shown in FIG. 14, causes wheel 16 to be rotated in exactly the same rotational velocity as shaft 74. As lever 94 is moved upwardly in a counterclockwise direction from the position shown in FIG. 14, the rotational pattern of wheel 16 begins to vary from the rotational pattern of shaft 74, and the degree of this variance is dependent upon how far lever 94 is rotated upwardly in a counterclockwise direction from the position shown in FIG. 14. Thus, it can be seen that the device of FIGS. 13 and 14 permits a continuous variable adjustment of the rotational pattern imparted to wheel 16. When wheel 18 is provided with identical drive system, the relative patterns of wheels 16 and 18 can be easily adjusted and synchronized to the desired relative patterns.

Thus, it can be seen that the device accomplishes at least all of its stated objectives.

What is claimed is:

1. A rotating piston machine comprising:

a cylindrical shaped housing having first and second circular end walls spaced apart from and parallel to one another, an outer annular wall extending axially between said first and second end walls, and an inner annular wall extending axially between said first and second end walls in concentric spaced relation to said outer annular wall whereby an annular chamber is formed by said inner and outer walls and said first and second end walls, a support frame, pivot means pivotally mounting said first and second circular end walls to said frame for rotational movement about a rotational axis, said first end wall being rotatable about said axis independently of said second end wall;

first and second groups of piston blades within said annular chamber, said blades being positioned to partition said annular chamber off into a plurality of circumferentially arranged compartments, said blades of said first group being positioned alternatively with said blades of said second group, said blades of said first group being connected to said first end wall for movement in unison therewith and said blades of said second group being connected to said second end wall for movement in unison therewith;

a group of inlet valves spaced circumferentially around said outer annular wall and providing communication from the exterior to the interior of said annular chamber, a group of outlet valves spaced circumferentially around said outer annular wall and providing communication from the interior to the exterior of said annular chamber, a first drive mechanism connected to said first end wall for rotating said first end wall about said rotational axis in a first predetermined pattern of increasing and decreasing rotational speed;

a second drive mechanism connected to said second end wall for rotating said second end wall about said rotational axis in a second predetermined pattern of increasing and decreasing rotational speed;

said first and second patterns of said first and second drive mechanisms being substantially the same and being out of phase with one another whereby the relative rotational speeds of said first and second end plates vary with respect to one another during at least a portion of each revolution thereof, a drive shaft, a counter shaft parallel and spaced from said drive shaft;

said first drive mechanism comprising a first pair of drive sprockets, one of said sprockets of said first pair being fixed to said drive shaft and the other of said sprockets of said first pair being fixed to said counter shaft; at least one of said sprockets of said first pair being mounted for rotation about an axis eccentrically located with respect to the geometric center thereof;

said second drive mechanism having a second pair of drive sprockets of identical construction to said first pair of sprockets, said second pair of sprockets being fixed to said drive and countershafts in the same manner as said first pair of sprockets and in a rotational position which is out of phase with said first pair of drive sprockets;

a first sprocket chain trained around said first pair of sprockets;

a second sprocket chain trained around said second pair of sprockets;

said first circular end wall having a circular pattern of teeth thereon drivingly engaging said first chain between said first pair of sprockets and said second circular end wall having a circular pattern of teeth thereon drivingly engaging said second chain between said second pair of sprockets.

2. A machine according to claim 1 wherein both sprockets of said first pair are mounted eccentrically and are rotated out of phase 180° with respect to each other, said sprockets of said second pair also both being mounted eccentrically and being 180° out of phase with one another.

3. A machine according to claim 2 wherein said sprocket of said first pair on said drive shaft is 180° out of phase with said sprocket of said second pair on said drive shaft.

* * * * *